United States Patent [19]

Bourgeois

[11] Patent Number: 4,535,751

[45] Date of Patent: Aug. 20, 1985

[54] HEAT RECUPERATOR FOR FIREPLACE

[75] Inventor: Jean-Louis Bourgeois, Duvernay, Canada

[73] Assignee: Foyer d'Aciernergie Inc., St. Vincent de Paul Laval, Canada

[21] Appl. No.: 610,122

[22] Filed: May 14, 1984

[51] Int. Cl.[3] ..... F24B 7/00

[52] U.S. Cl. ..... 126/121; 126/123; 126/131; 237/51

[58] Field of Search ..... 126/120, 110 B, 121, 126/123, 126, 125, 164, 130, 131, 137, 141, 165; 237/51, 55

[56] References Cited

U.S. PATENT DOCUMENTS

| | | | |
|---|---|---|---|
| 1,334,827 | 3/1920 | Yost | 126/67 |
| 4,007,726 | 2/1977 | Kenchel | 126/67 |
| 4,085,725 | 4/1978 | Mesenbrink | 126/67 |
| 4,111,182 | 9/1978 | Roberts | 126/110 B |
| 4,127,100 | 11/1978 | Baker | 126/110 B |
| 4,128,094 | 12/1978 | Lewis | 126/110 B |
| 4,132,263 | 1/1979 | Stinnett | 126/121 |
| 4,150,658 | 4/1979 | Woods | 126/121 |
| 4,154,210 | 5/1979 | Jaymes | 126/72 |
| 4,169,458 | 10/1979 | Shaw | 126/120 |
| 4,174,700 | 11/1979 | Bartsch | 126/288 |
| 4,206,743 | 6/1980 | Niemela | 126/110 B |
| 4,206,804 | 6/1980 | Scholtes | 126/67 |

FOREIGN PATENT DOCUMENTS

| | | | |
|---|---|---|---|
| 8416 | 1/1878 | Canada | 126/121 |
| 988386 | 5/1976 | Canada | 126/121 |
| 1022818 | 12/1977 | Canada | 126/121 |
| 1036033 | 8/1978 | Canada | 126/121 |
| 1044100 | 12/1978 | Canada | 126/121 |
| 1077361 | 5/1980 | Canada | 126/121 |
| 2047875 | 12/1980 | United Kingdom | 126/123 |

*Primary Examiner*—James C. Yeung

*Attorney, Agent, or Firm*—Robic, Robic & Associates

[57] ABSTRACT

Forced air space heating fireplace having a metal casing defining a combustion chamber with an opening facing a room to be heated. Air flow tubes are provided beneath the floor of the combustion chamber and at the top, the air flow tubes being interconnected by lateral air flow tubes then lying outside the casing. The interconnection is such that the tubes form a continuous air flow path having an air inlet connected to a blower, which draws fresh air from outside the room to be heated, and two air outlets disposed laterally of the casing and opening into the room to be heated. In one form, the lateral flow tubes are encased in an insulating brick construction. In an other alternative, they may be contained in a jacket surrounding the casing and also including the top air flow tubes.

16 Claims, 6 Drawing Figures

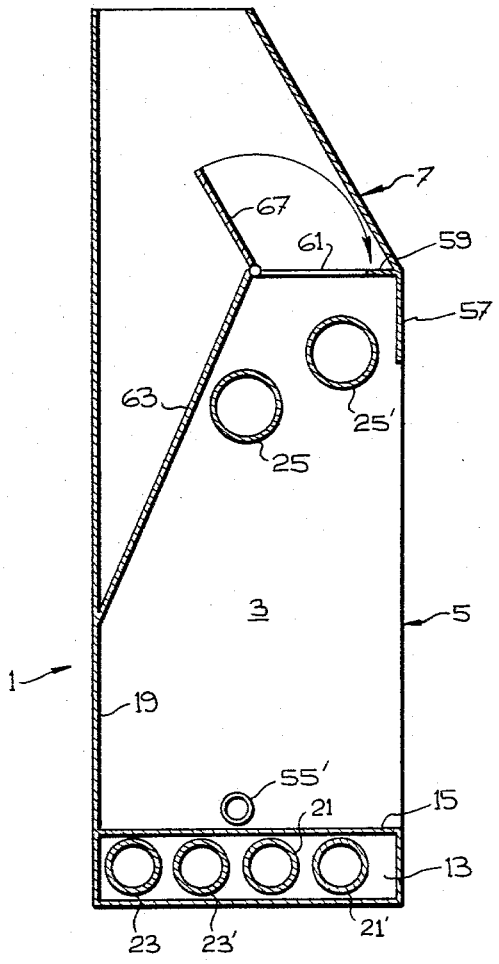
FIG. 2
FIG. 3
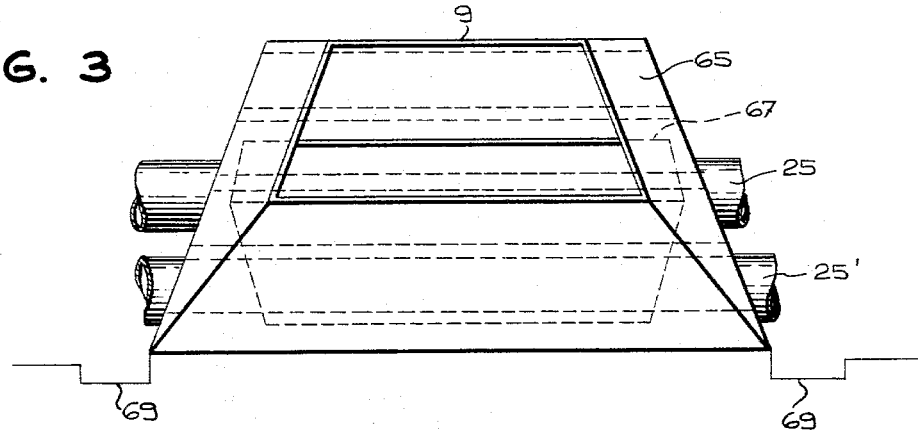

HEAT RECUPERATOR FOR FIREPLACE

The present invention relates to a metal fireplace built to efficiently use the heat generated by a fire burning in its combustion chamber. It is particularly directed towards such a fireplace which draws outside air which picks up heat from the fire and is then discharged into a room to be heated so that not only is the fireplace more efficient but it also serves to introduce heated fresh air into the room.

Conventional fireplaces are of course well known for their inefficiency in heating a room since the larger part of the heat generated by the fire goes up the chimney or flue although a very limited amount is saved as radiant heat. Furthermore, air moving out of the room through the chimney depressurizes the room so that cold outside air is drawn into the room from around windows and doors.

The following lists of prior art patents show that many attempts have been made in the past to provide efficient fireplace heating installations either as a conversion of an existing fireplace or as a new unit:

U.S. Pat. Nos.

1,334,827—(1920)—Yost
4,007,726—(1977)—Kenchel
4,085,725—(1978)—Mesenbrink
4,111,182—(1978)—Roberts
4,127,100—(1978)—Baker
4,128,094—(1978)—Lewis
4,150,658—(1979)—Woods
4,154,210—(1979)—Jaymes
4,169,458—(1979)—Shaw
4,206,743—(1980)—Niemela
4,206,804—(1980)—Scholtes Canadian Pat. Nos.

8,416—(1878)—Dimmick
988,386—(1976)—Hatfield
1,022,818—(1977)—Adams
1,036,033—(1978)—Lassy
1,044,100—(1978)—Stites
1,077,361—(1980)—Shaw A study of the above patents shows many deficiencies either as to efficiency, constructional cost, which it is the purpose of the present invention to avoid.

Thus, it is an important object of the invention to provide a fireplace which absorbs heat from a fire by conduction, beneath and laterally of the fire, as well as by convection and, preferably, radiation from above the fire. This is achieved by providing a set of properly located tubes interconnected to define a continuous flow path into which air is forced, being drawn from outside the room to be heated and being discharged into it. Additionally, the fireplace according to the invention is constructed so that the air tubes may be entirely hidden from view thereby promoting the esthetic appearance of the fireplace.

More specifically and in accordance with the broad concept of the invention as herein claimed, there is provided a forced air space heating fireplace for heating a room, said fireplace comprising:

(a) a metal casing defining a combustion chamber having an opening facing said room to be heated, said casing comprising:

top wall means having a flue connection for the exit of gas from said combustion chamber;

lower wall means defining an enclosure closed at the top by a floor wall for the support of a grate;

a pair of side walls connected, at the bottom, to said floor wall and, at the top, to said top wall means;

a back wall connected, at the bottom, to said floor wall, at the top to said top wall means and, along vertical side edges thereof, to said side walls, said back wall facing said combustion chamber opening;

(b) forced air flow circuit means comprising:

lower air flow tubes, beneath said floor wall, in and across said enclosure, between said side walls;

upper air flow tubes at the top and across said combustion chamber;

lateral air flow tube means outside said casing, said lateral tube means interconnecting said lower and upper tubes to form therewith a single air flow path having one air inlet and a pair of air outlet, said air outlets opening on either side of said casing, outwardly thereof, to face said room to be heated whereby to discharge heated air thereinto;

means surrounding said casing except for said combustion chamber opening and said air outlets and enclosing said lateral air flow tube means, and (c) a blower connected to said air inlet to force air through said air flow path and out through said air outlets into said room to be heated, said blower being disposed to draw air from outside said room to be heated.

In accordance to one preferred embodiment, the upper air flow tubes are exposed to radiant heat from a fire in the combustion chamber and are disposed between the combustion chamber and the flue gas connection so as to be also exposed to convection heat from combustion gas produced by the fire.

Preferably also, the means surrounding the casing to enclose the lateral air flow tube means comprise a heat insulation brick construction and an inner finishing wall construction over the brick construction, the finishing wall construction being flush with the combustion chamber opening and the air outlets.

In another form of the invention, the aforementioned means surrounding the casing to enclose the lateral air flow means comprise a closed metal jacket formed around the side and sealing walls of the casing, the interconnecting air flow tubes and the upper air flow tubes being contained in the space between the jacket and the casing thereby serving to cool the said space.

A better understanding of the invention will be afforded from the description that follows of two preferred embodiments, description having reference to the appended drawing wherein:

FIG. 2 is a cross-sectional view of the casing of the fireplace of FIG. 1 taken in a central vertical plane;

FIG. 3 is a top plan view of the casing of FIG. 2;

Figure 1:
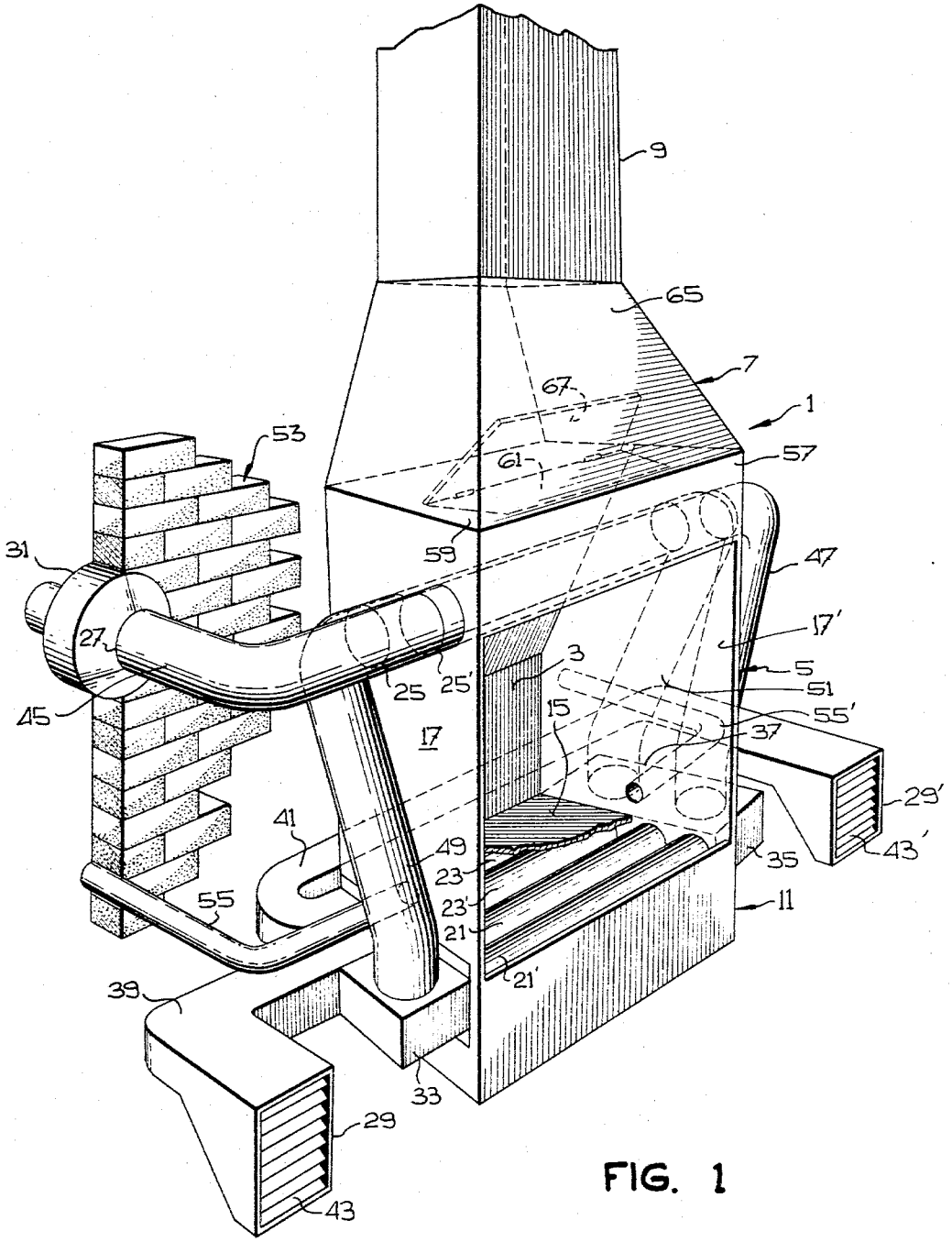
FIG. 1 is a diagrammatic perspective view of a fireplace according to one embodiment of the invention.

Referring to the embodiment of FIGS. 1, 2 and 3, the fireplace has a metal casing 1 which defines an inner combustion chamber 3 having a front opening 5 which looks out on the room to be heated.

The casing 1 generally comprises a top wall means 7 having a flue connection 9 for the exit of gas from the combustion chamber 3; a lower wall means 11 which defines an enclosure 13 (FIG. 2) closed at the top by a floor wall 15 for the support of a grate (not shown) of conventional type; a pair of side walls 17, 17′ connected, at the bottom, to the floor wall 15 and, at the top, to the top wall means 7, and a back wall 19 (FIG. 2) connected, at the bottom, to the floor wall 15, at the top to the top wall means 7 and, along their vertical edges, to the side walls 17, 17′, the back wall 19 facing of course the combustion chamber opening 5.

A forced air flow circuit draws fresh air from the outside, circulates it around the combustion chamber and discharges it into the room to be heated. This circuit is made up of the following components.

Lower air flow tubes, beneath the floor wall 15, located in the enclosure 13 and extending thereacross between the side walls 17, 17′. As best seen in FIG. 2, there are two lower forward tubes 21, 21′ and two lower rearward tubes 23, 23′. Two upper tubes are also provided at the top of the combustion chamber 3, one forward one 25′ and one rearward one 25.

The forced air flow circuit is completed by lateral air flow tube means lying outside the casing and interconnecting the lower and the upper tubes 21, 21′, 23, 23′, 25, 25′ to form therewith a single air flow path having one air inlet 27 (FIG. 1) and a pair of air outlets 29, 29′, the latter opening on either side of the casing 1, outwardly thereof, and facing the room to be heated. The circuit is completed by a blower 31 which is connected to the air inlet 27 and which forces air through the air flow path, aforesaid, to discharge it through the air outlets 29, 29′ into the room to be heated, the blower 31 being disposed, as will be further explained hereinafter, to draw air from the outside of the room to be heated so as to provide the latter with fresh but heated air. It will then be appreciated that this air pressurizes the room to be heated and therefore hinders the inflow of air from around windows and doors.

The lower forward tubes 21, 21′ extend, at their ends, through the side walls 17, 17′ to open into plenum boxes 33, 35, secured to the casing side walls 17, 17′ outwardly of the combustion chamber 3.

The rightward ends of the lower rearward tubes 23, 23′, as viewed when facing the casing 1 in FIG. 1, likewise extend through the side walls 17′ to simultaneously open into a further plenum box 37 located behind plenum box 35. The opposite ends of the lower rearward tubes 23, 23′ extend across the side wall 17. The lower tube 23′ opens into one end of an outlet air tube 39, in the form of a square conduit, the other end of which forms the previously mentioned air outlet 29. As to the adjacent end of the other rearward tube 23, it opens into one end of a second outlet air tube 41 of which the other end forms the air outlet 29′, tube or square conduit 41 extending along the backwall 19 outwardly of the combustion chamber 3. Both air outlets 29, 29′ may be provided with pivotable louvers 43, 43′ which can be adjusted so as to adequately equalize the air pressure in the outlet air tubes 39, 41. It will of course be understood that these louvers 43, 43′ may be stationary, the conduits 39, 41 being then provided with a conventional type of pivotable louvers manually operable from inside the room to be heated.

The uninterrupted flow path mentioned above is completed as follows.

A first connecting tube 45 joins the blower 31, from the air inlet 27, with one end of the upper tube 25′ of which the other end is connected, by means of a further connecting tube 47 to the forward plenum box 35. In turn, the other forward plenum box 33 is connected to the rearward upper tube 25 by means of an additional connecting tube 49. Finally, a last connecting tube 51 joins the rightward end of the upper tube 25 to the rearward plenum box 37.

From the above description, it follows that fresh air from the outside atmosphere is drawn in by blower 31, flows successively through the connecting tube 45, the front upper tube 25′ of the combustion chamber, through the connecting tube 47 into the front plenum box 35 and hence through both lower forward tubes 21, 21′ beneath the floor wall 15, into the second front plenum box 33 and from there into the connecting tube 49 leading into the rearward upper tube 25 and from there into the rear plenum box 37 after having travelled through the connecting tube 51. From the plenum box 37, the air is forced into the lower rearward tubes 23, 23′, beneath the floor wall 15, the other ends of these two tubes 23, 23′ opening respectively into the outlet air tubes 39, 41 to finally discharge into the room to be heated through the louvered air outlets 29, 29′.

It will be appreciated that the single air flow path thus described fully circumscribes the combustion chamber 3 and thus efficiently absorbs heat from the fire therein by conduction, convection and radiation.

As mentioned before, means surround the metal casing 1 except for the combustion chamber opening 5 and the air outlets 29, 29′, such means enclosing the lateral air flow tube means aforedescribed comprising the blower 31, the plenum boxes 33, 35 and 37, the outlet air tubes 39, 41 and the connecting tubes 45, 47, 49 and 51. In the embodiment of FIG. 1, the surrounding means takes the form of an assembly made up of a heat insulating brick construction or brick work 53 of conventional conception and an inner finishing wall construction (not shown) over the brick construction 53, the finishing wall construction being of course flush with the combustion chamber opening 5 and the air outlets 29, 29′, so that the latter may unobstructively open into the room to be heated. It will further be appreciated that this brick construction and inner finishing wall construction need not be further described, being well within the skill of any one versed in the construction art.

Thus, the fire place as disclosed in FIGS. 1, 2 and 3 is conceived to be mounted on one existing wall of the room to be heated.

Particularly from FIG. 2, it will be noted that the upper air flow tubes 25, 25′, are exposed to radiant heat from a fire in the combustion chamber 3 and are also disposed between the said combustion chamber 3 and the flue gas connection 9 so as to be likewise exposed to the convection heat from the combustion gas produced by the fire.

The said fire apart from being fed with combustion air coming from the room to be heated may additionally and advantageously be kept up by outside air being fed into the combustion chamber 3 by means of a pair of combustion air pipes 55, 55′, each having an air outlet end which opens into the combustion chamber 3 through one of the side walls 17, 17′ as clearly shown in FIG. 1, the air inlet end of the pipes 55, 55′ opening outside of the room to be heated and the pipes being contained in the brick work 53.

As can also be gathered easily from the above description and FIGS. 1 and 2, there may be one lower forward tube interconnecting the two plenum chambers 33, 35, and there may be more than two. However, two lower rearward tubes 33, 33' are necessary since there are two outlet air tubes 39, 41, to be independently fed although it is imaginable that a single appropriately designed tube may be used to feed both outlet air tubes 39, 41, although not as efficiently at least from a construction view point.

As perhaps best seen in FIG. 2, the casing 1 may appropriately be provided with a masking plate 57 depending from the top wall means 7 in the plane and at the top of the combustion chamber opening 5 so that it may hide, at least partially, the upper air flow tubes 25, 25', to improve the esthetic appearance of the fireplace.

The above-mentioned top wall means may be made up of a horizontal top plate 59 extending between the casing side walls 17, 17' from the top edge of the masking plate 57 but terminating short of the back wall 19. This top plate 59 has a central flue gas opening 61 located above the upper air flow tubes 25, 25'. An inclined baffle plate 63 joins the rear edge of the top plate 59 and the casing rear wall 19 whereby to direct combustion gases toward the upper air flow tubes 25, 25', and the central flue opening 61 to finally move up into the flue connection 9. As shown in FIG. 1, the top wall means 7 further comprises a truncated hood 65 of which the lower base is secured to the casing 1 and the narrow upper base receives the stack or flue connection 9 so that the combustion gases may be discharged to atmosphere. With reference to FIG. 2, a damper 67 may appropriately be pivotally mounted on the top plate 59 for freeing and closing the flue gas opening 61. The damper 67 may be provided with any conventional manually operable mechanism.

It is lastly pointed out that the blower 31 may be fully encased in the brick construction 53.

As will readily be seen from the above description, the invention provides an extremely efficient forced air space heating fireplace wherein all the air flow circuitry is concealed from view so that, in appearance when the brick wall and inner finishing work are completed, the appearance is exactly that of a standard fireplace having no provision for heat recuperation. Thus, a decorative brick or stone frame 69 (FIG. 3) may be built all around the front opening 5. In this manner, the only apparent parts of the fireplace will be the combustion chamber 3, with no air flow tube showing, and of course the louvered air outlets 29, 29', lying in the plane of the surface of the inner finishing wall and, preferably for esthetic purposes, at a distance from the combustion chamber.

Figure 4:
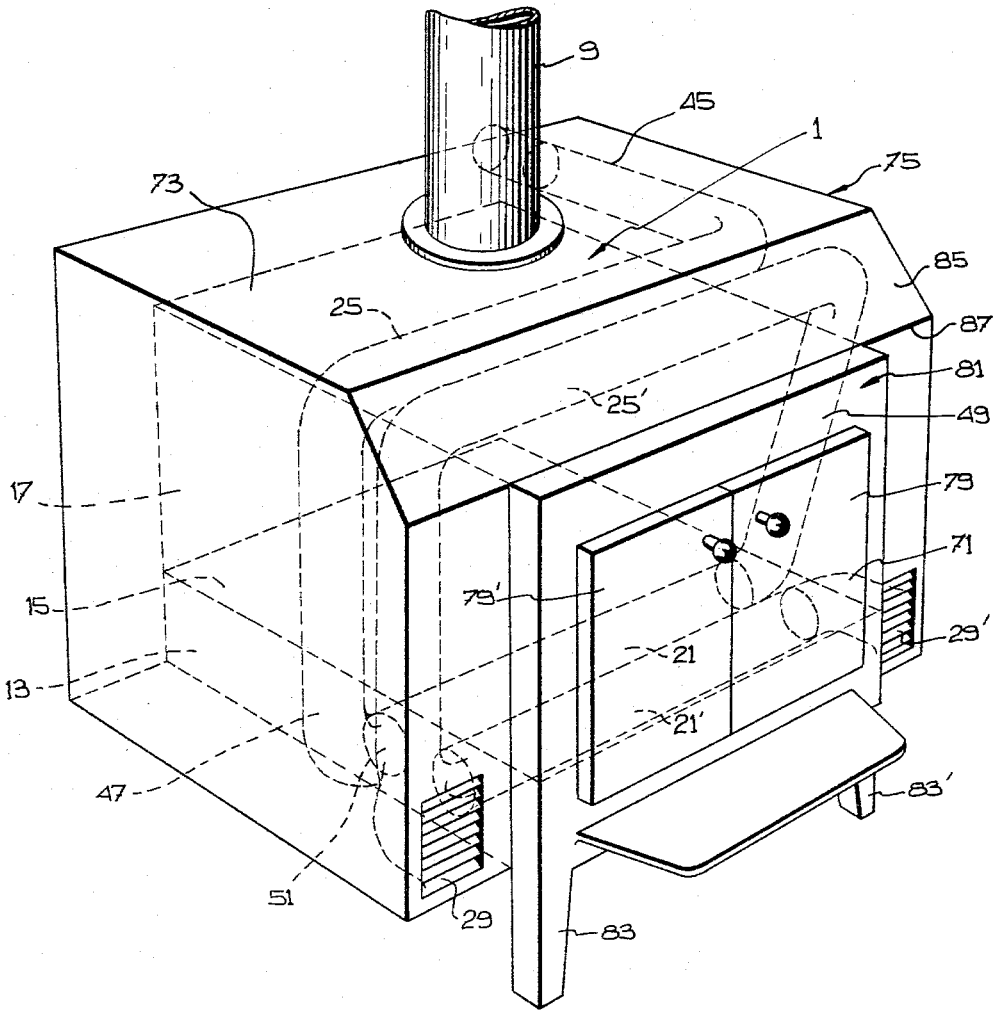
FIG. 4 is a diagrammatic perspective view of a fireplace according to a second embodiment of the invention.
Figure 5:
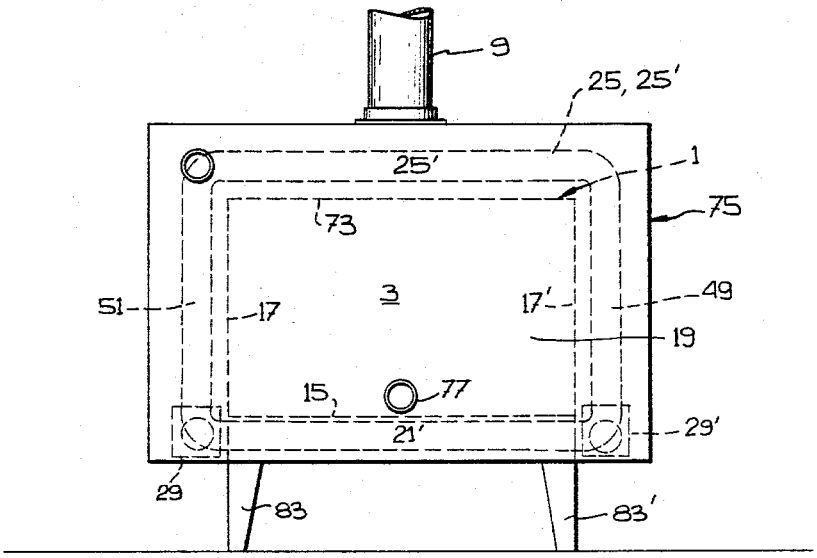
FIG. 5 is a front elevation view of the fireplace of FIG. 4.
Figure 6:
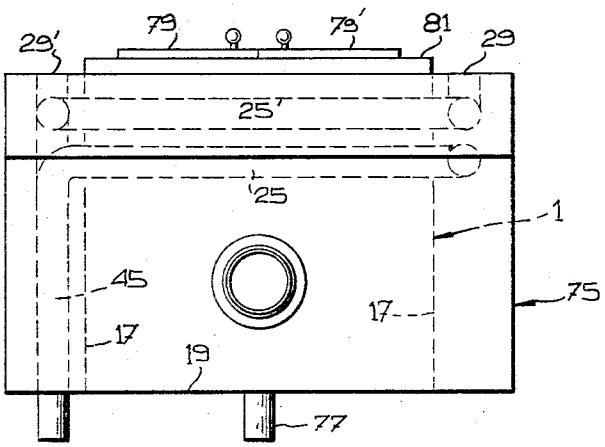
FIG. 6 is a top plan view of the fireplace according to FIG. 4.

In the particular embodiment illustrated in FIGS. 4, 5 and 6, where like reference numerals identify like parts, two lower air flow tubes 21, 21' are provided beneath the floor wall 15 and in the enclosure 13. Two upper air flow tubes 25 and 25' are likewise provided. In this case, the interconnecting air flow means comprise a tube 45 joining the blower (not shown but corresponding to the blower 31 of the embodiment of FIG. 1) and one end of the upper tube 25 the other end of which is connected to a downwardly directed connecting tube 47 joined at the lower end to the adjacent end of the lower tube 21' of which the rightward end is connected to the upwardly directed connecting tube 49 joining the second upper tube 25' which, itself, is operatively connected to the second downwardly directed connecting tube 51 of which the lower end splits up conjointly to feed into the lower tube 21 and the air outlet 29, the other end of the lower tube 21 being connected to the air outlet 29' through a short connecting tube 71.

In this embodiment, the top wall means comprise a generally flat sealing wall 73 at the top of the combustion chamber 3 and below the upper air flow tube 25, 25', the flue connection 9 being connected generally centrally of the ceiling wall 73 for direct access to the combustion chamber 3.

In this particular instance, the means surrounding the casing and enclosing the lateral air flow means comprise a closed metal jacket 75 formed around the side and ceiling walls 17, 17', 73, of the casing, the interconnecting air flow tubes 45, 47, 49, 51 and 71 and the upper air flow tubes 25, 25' being contained in the space between the jacket 75 and the casing 1 thereby serving to cool the said space.

As in the case of the first embodiment, a combustion air pipe 77 may be provided which has an air outlet end opening into the combustion chamber 3 through the casing back wall 19 and an air inlet end opening outside the room to be heated.

It will be noted that in this instance, all air flow tubes completely circumscribe the combustion chamber 3 and are completely hidden from view particularly with the addition of the ceiling wall 73, hiding the upper tubes 25, 25'.

For convenience and esthetic purposes, a pair of doors 79, 79' may be pivotally mounted on a frame 81, appropriately circumscribing the combustion chamber opening, and serving of course to open and close it. This frame 81 may, laterally, extend down into a pair of legs 83, 83' for supporting the fire place above the ground, like frame legs (not shown) being provided at the rear end of the jacket 75.

Finally, a front inclined plate 85 joins the top wall of the jacket 75 with the front edge 87 of the casing ceiling wall 73.

As will readily be apparent from the above description, the fireplace according to the embodiment of FIGS. 4, 5 and 6 is for particular use fully inside the room to be heated. By its particular construction, it will be seen that the space around the side walls 17, 17' and ceiling wall 73 of the casing defining the inner combustion chamber are adequately isolated by the outer jacket 75, the air flow tubular circuit further cooling the space between the inner casing 1 and outer jacket 75. The front part of the inner casing 1, around the combustion chamber opening, may likewise be adequately isolated by making the door frame 81 hollow.

I claim:

1. A forced air space heating fireplace for heating a room, said fireplace comprising:

(a) a metal casing defining a combustion chamber having an opening facing said room to be heated, said casing comprising:

top wall means having a flue connection for the exit of gas from said combustion chamber;

lower wall means defining an enclosure closed at the top by a floor wall for the support of a grate;

a pair of side walls connected, at the bottom, to said floor wall and, at the top, to said top wall means;

a back wall connected, at the bottom, to said floor wall, at the top to said top wall means and, along vertical side edges thereof, to said side walls, said back wall facing said combustion chamber opening;

(b) forced air flow circuit means comprising:

lower air flow tubes, beneath said floor wall, in and across said enclosure, between said said side walls;

upper air flow tubes at the top and across said combustion chamber;

lateral air flow tube means outside said casing, said lateral tube means interconnecting said lower and upper tubes to form therewith a single air flow path having one air inlet and a pair of air outlet, said air outlets opening on either side of said casing, outwardly thereof, to face said room to be heated whereby to discharge heated air thereinto;

means surrounding said casing except for said combustion chamber opening and said air outlets and enclosing said lateral air flow tube means, and (c) a blower connected to said air inlet to force air through said air flow path and out through said air outlets into said room to be heated, said blower being disposed to draw air from outside said room to be heated, wherein said upper air flow tubes are exposed to radiant heat from a fire in said combustion chamber and are disposed between said combustion chamber and said flue gas connection so as to be also exposed to convection heat from combustion gases produced by said fire, wherein said lower air flow tubes comprise at least one forward tube and two rearward tubes and said upper air flow tubes comprise two air flow tubes, said lateral air flow tube means comprising:

a pair of forward plenum boxes each on one of said casing side walls and in said casing surrounding means, said forward tube being operatively connected, at the ends thereof, to said forward plenum boxes;

a rearward plenum box on one of said casing side walls and in said surrounding means, said rearward plenum box being operatively connected to adjacent ends of said rearward tubes;

a pair of outlet air tubes each connected at the ends thereof respectively to the other end of one of said rearward tubes and to one of said air outlets;

interconnecting air flow tubes respectively joining said blower and one end of one of said upper tubes; the other end of said one of said upper tubes and one of said forward plenum boxes; the other of said forward plenum boxes and one end of the other of said upper tubes, and the other end of the other of said upper tubes and said rearward plenum box, whereby said air flow tubes circumscribes said combustion chamber.

2. A fireplace as claimed in claim 1, further comprising a pair of combustion air pipes, each having an air outlet end opening into said combustion chamber through one of said side walls and an air inlet end opening outside said room to be heated, said air pipes being contained in said means surrounding said casing.

3. A fireplace as claimed in claim 1 further comprising a combustion air pipe having an air outlet end opening into said combustion chamber through said casing back wall and an air inlet end opening outside said room to be heated.

4. A fireplace as claimed in claim 1, comprising two forward tubes operatively connected, at the ends thereof, to said forward plenum boxes.

5. A fireplace as claimed in claim 1, wherein said means surrounding said casing comprises: a heat insulation brick construction and an inner finishing wall construction over said brick construction, said finishing wall construction being flush with said combustion chamber opening and said air outlets.

6. A fireplace as claimed in claim 5, wherein said casing further comprises: a masking plate depending from said top wall means in the plane and at the top of said combustion chamber opening to at least partially hide said upper flow tubes.

7. A fireplace as claimed in claim 6, wherein said top wall means comprise:

a horizontal top plate extending between said casing side walls from the top edge of said masking plate; said top plate having a central flue gas opening located above said upper air flow tubes;

an inclined baffle plate joining the rear edge of said top plate and said casing back wall to direct combustion gases toward said upper air flow tubes and said central flue opening;

a truncated hood having a large lower base secured to said casing and a narrow upper base, and wherein said flue connection is mounted on said narrow upper base for the discharge of combustion gases to atmosphere.

8. A fireplace as claimed in claim 7, including a damper pivotally mounted on said top plate for freeing and closing said flue gas opening.

9. A fireplace as claimed in claim 5, wherein said blower is encased in said heat insulation brick construction.

10. A forced air space heating fireplace for heating a room, said fireplace comprising:

(a) a metal casing defining a combustion chamber having an opening facing said room to be heated, said casing comprising:

top wall means having a flue connection for the exit of gas from said combustion chamber;

lower wall means defining an enclosure closed at the top by a floor wall for the support the support of a grate;

a pair of side walls connected, at the bottom, to said floor wall and, at the top, to said top wall means;

a back wall connected, at the bottom, to said floor wall, at the top to said top wall means and, along vertical side edges thereof, to said side walls, said back wall facing said combustion chamber opening;

(b) forced air flow circuit means comprising:

lower air flow tubes, beneath said floor wall, in and across said enclosure, between said side walls;

upper air flow tubes at the top and across said combustion chamber;

lateral air flow tube means outside said casing, said lateral tube means interconnecting said lower and upper tubes to form therewith a single air flow path having one air inlet and a pair of air outlet, said air outlets opening on either side of said casing, outwardly thereof, to face said room to be heated whereby to discharge heated air thereinto;

means surrounding said casing except for said combustion chamber opening and said air outlets and enclosing said lateral air flow tube means, and (c) a blower connected to said air flow inlet to force air through said air flow path and out through said air outlets into said room to be heated, said blower being disposed to draw air from outside said room to be heated, wherein said lower air flow tubes are two in number and said upper air flow tubes are two in number, said lateral air flow means comprising interconnecting air flow tubes respectively joining said blower and end of one of said upper tubes; the other end of said one of said upper tubes and the adjacent end of one of said lower tubes; the other end of said one of said lower tubes and the adjacent end of the other of said upper tubes; the other end of said other of said upper tubes; and, conjointly, the adjacent end of the other of said lower tubes and one of said air outlets; and the other end of said other lower tube and the other of said air outlets whereby said air flow tubes circumscribe said combustion chamber.

11. A fireplace as claimed in claim 10, wherein said top wall means comprise: a generally flat ceiling wall at the top of said combustion chamber and below said upper air flow tubes, said flue connection being mounted generally centrally of said ceiling wall for direct access to said combustion chamber, and wherein said means surrounding said casing and enclosing said lateral air flow tube means comprise a closed metal jacket formed around said side and ceiling walls of said casing, said interconnecting air flow tubes and upper flow tubes being contained in the space between said jacket and said casing thereby serving to cool said space.

12. A fireplace as claimed in claim 11, including a pair of doors pivotally mounted on said casing to open and close said combustion chamber opening.

13. A fireplace as claimed in claim 10, further comprising at least one combustion air pipe having an air outlet end opening into said combustion chamber and an air inlet end opening outside said room to be heated.

14. A forced air space heating fireplace for heating a room, said fireplace comprising:

(a) a metal casing defining a combustion chamber having an opening facing said room to be heated, said casing comprising:

top wall means having a flue connection for the exit of gas from said combustion chamber;

lower wall means defining an enclosure closed at the top by a floor wall for the support of a grate;

a pair of side walls connected, at the bottom, to said floor wall, at the top to said top wall means and, along vertical side edges thereof, to said side walls, said back wall facing said combustion chamber opening;

(b) a forced air flow circuit comprising:

two lower air flow passages provided in and across said enclosure between said side walls;

two upper air flow tubes at the top and across said combustion chamber;

lateral air flow tube means outside said casing, said lateral tube means interconnecting said lower passages and upper tubes to form therewith a single air flow path circumscribing the combustion chamber and having one air inlet and a pair of air outlet, said air outlets opening on either side of said casing, outwardly thereof, to face said room to be heated whereby to discharge heated air thereinto; and means surrounding said casing except for said combustion chamber opening and said air outlets and enclosing said lateral air flow passage means, and (c) a blower connected to said air inlet to force air through said air flow path and out through said air outlets into said room to be heated, said blower being disposed to draw air from outside said room to be heated, (d) wherein said lateral air flow tube means comprises a plurality of interconnecting air flow tubes respectively joining said blower and one end of one of said upper tubes; the other end of said one of said upper tubes and the adjacent end of one of said lower passages; the other end of said one of said lower passages and the adjacent end of the other of said upper tubes; the other end of said other of said upper tubes and the adjacent end of the other of said lower passages; and the other end of said other lower passages and each of said air outlets.

15. A fireplace as claimed in claim 14, further comprising at least one combustion air pipe having an air outlet end opening into said combustion chamber through said casing and an air inlet end opening outside said room to be heated.

16. A fireplace as claimed in claim 15, including a pair of doors pivotably mounted on said casing to open and close said combustion chamber opening.

* * * * *